US008967843B2

(12) United States Patent
Jackl et al.

(10) Patent No.: US 8,967,843 B2
(45) Date of Patent: Mar. 3, 2015

(54) LED VEHICLE HEADLAMP

(75) Inventors: Christian Jackl, Wieselburg (AT); Irmgard Krenn, Purgstall/Erlauf (AT); Markus Lahner, St. Polten (AT)

(73) Assignee: Zizala Lichtsysteme GmbH, Wieselburg (AT)

( * ) Notice: Subject to any disclaimer, the term of this patent is extended or adjusted under 35 U.S.C. 154(b) by 162 days.

(21) Appl. No.: 13/879,287

(22) PCT Filed: Jul. 27, 2011

(86) PCT No.: PCT/AT2011/000315

§ 371 (c)(1), (2), (4) Date: Apr. 12, 2013

(87) PCT Pub. No.: WO2012/048351

PCT Pub. Date: Apr. 19, 2012

(65) Prior Publication Data

US 2013/0215632 A1 Aug. 22, 2013

(30) Foreign Application Priority Data

Oct. 14, 2010 (AT) ..... A 1715/2010

(51) Int. Cl.
*F21V 7/00* (2006.01)
*F21S 8/10* (2006.01)

(52) U.S. Cl.
CPC ..... *F21S 48/1757* (2013.01); *F21S 48/1109* (2013.01); *F21S 48/1305* (2013.01); *F21S 48/1159* (2013.01); *F21S 48/137* (2013.01)
USPC ..... 362/517; 362/283; 362/246

(58) Field of Classification Search
USPC ..... 362/464, 475, 507, 509, 512, 517, 519, 362/521, 522, 538, 539, 543, 227, 235, 237, 362/241, 247, 249.01, 249.02, 319, 322, 362/341, 346, 347, 361, 800, 802
See application file for complete search history.

(56) References Cited

U.S. PATENT DOCUMENTS

| | | | | |
|---|---|---|---|---|
| 8,201,980 | B2 * | 6/2012 | Ookubo et al. | 362/517 |
| 8,240,896 | B2 * | 8/2012 | Abe | 362/514 |
| 8,246,227 | B2 * | 8/2012 | Okubo et al. | 362/514 |

* cited by examiner

*Primary Examiner* — Hargobind S Sawhney
(74) *Attorney, Agent, or Firm* — Sutherland Asbill & Brennan LLP

(57) ABSTRACT

A vehicle headlight includes at least one stationary reflector and at least one reflector adjustable with respect to the at least one stationary reflector. The headlight includes at least two light sources including at least one LED, wherein each of the reflectors is assigned at least one of the light sources, and an assembly body for fastening the at least one stationary reflector and the at least two light sources. The assembly body includes a main body, on which the at least one stationary reflector is assembled. and an exchange body, on which the at least two light sources are fastened. The main body has a through-opening for insertion of a light source support element from the side facing away from the reflectors. Referencing or positioning means are provided on the exchange body in order to fasten the two bodies to one another in a positionally accurate manner.

24 Claims, 4 Drawing Sheets

LED VEHICLE HEADLAMP

CROSS-REFERENCE TO RELATED APPLICATIONS

Figure 1:
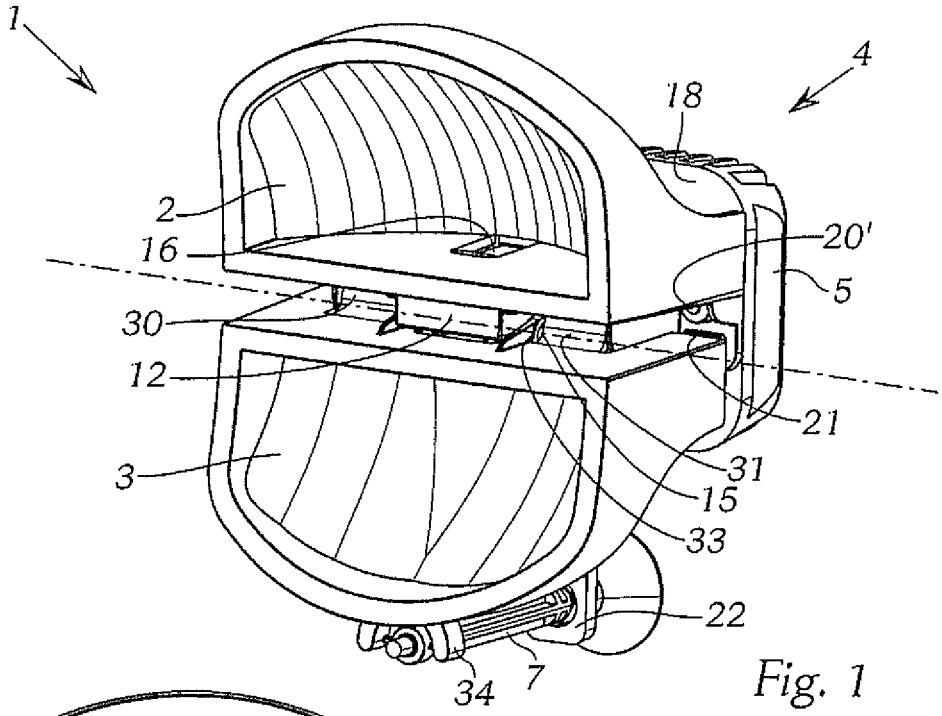

This application is the national stage of International Application No. PCT/AT2011/00315, filed Jul. 27, 2011, and claims priority benefit of Austrian Patent Application No. A 1715/2010, filed Oct. 14, 2010. These applications are incorporated by reference herein.

The invention relates to a vehicle headlight with a first reflector arrangement, which comprises at least one stationary reflector, and with a second reflector arrangement, which comprises at least one reflector adjustable with respect to the at least one stationary reflector of the first reflector arrangement.

After the installation of a vehicle headlight in a motor vehicle, it is necessary and legally required to adjust the light exposure produced by the headlight so that the light exposure produced by the motor vehicle headlight complies with the legal requirements.

If the headlight is a headlight of the type that has two (or more) reflector arrangements, of which each reflector arrangement produces a different light exposure, for example a reflector arrangement of a dipped beam distribution and another reflector arrangement of a high beam distribution, it is then also necessary for the two reflector arrangements or the reflectors of the individual arrangements to be aligned with one another so that the light distributions are matched to one another and the legal provisions are met.

If LEDs are used as light sources, an extremely precise positioning of the light sources with respect to the reflectors assigned to the light sources is necessary due to the very low tolerances in this case. In addition, it is now becoming increasingly required for light sources in the form of LEDs to also be exchangeable, whereby there is not only the problem of extremely accurate positioning, but also the problem that the light sources are again arranged in the correct position, even after replacement.

Document JP 2000-133026 A discloses a vehicle headlight with a variable light distribution. The variable light distribution is achieved by a two-part reflector, wherein the upper reflector part is pivotable about a vertical axis. The lower reflector part is arranged in a fixed manner. The headlight comprises only one individual light source, which illuminates both reflector parts.

Document JP 2008-192313 A discloses a vehicle headlight with a two-part upper and lower reflector for two different beam geometries. An LED is used as a light source and is arranged pivotably about an axis orthogonal to its direction of emission. In this way, either the upper or the lower reflector is illuminated. Both reflector parts are positioned immovably and fixedly relative to one another.

Document US 2009097247 A1 likewise discloses a vehicle headlight with a two-part upper and lower reflector. Both reflector parts are positioned fixedly relative to one another. Two LEDs are attached on a support between the two reflector parts, wherein each LED is assigned to a reflector. The support of the LEDs is positioned fixedly relative to the two reflector parts.

The object of the invention is to specify a headlight, with which an exact positioning of two or more reflector arrangements relative to one another is possible in a simple manner, an exact positioning of the light sources with respect to the reflectors is possible, and a simple exchange of the light sources is also possible, wherein the new light sources are again located in the correct position after the exchange.

This object is achieved with a vehicle headlight of the type mentioned in the introduction, with which at least two light sources are provided, wherein at least one of the light sources is assigned to each of the reflectors, and wherein each light source comprises at least one LED, and an assembly body is provided for fastening the at least one fixed reflector and the at least two light sources, wherein the assembly body consists of an assembly main body, on which the at least one fixed reflector is assembled in a stationary manner, and also consists of an assembly exchange body, to which the at least two light sources are fastened, and wherein the at least one adjustable reflector is arranged on the same side of the assembly main body as the at least one stationary reflector and is adjustable with respect to the at least one stationary reflector, and wherein the assembly main body has a through-opening for insertion of a light source support element from the side facing away from the reflectors, wherein the light source support element is connected to the assembly exchange body and carries the at least two light sources, and wherein the assembly exchange body can be fastened releasably to the assembly main body, and wherein referencing or positioning means are provided on the assembly exchange body and on the assembly main body for fastening the two bodies to one another in a positionally accurate manner.

Due to the division of the normally one-piece assembly body into an assembly main body, which carries the stationary and the adjustable reflector(s), and into an assembly exchange body, which carries the light sources and which can be connected to the assembly main body in a positionally accurate manner, the reflectors can be set relative to one another in an exact manner and the light sources can be positioned in an exact manner. In addition, the adjustable reflector is held in its set position, even when the light sources are exchanged, so that, once the new light sources have been inserted, again in a positionally accurate manner, said light sources again sit in the correct position.

It is fundamentally advantageous, in particular in view of a simple manufacturing process, but also in view of a reliable positioning of the light sources and in particular in view of an optimal thermal dissipation, if the light source support element and the assembly exchange body are formed in one piece.

In principle, the different reflector arrangements can also contribute to the same light exposure, although the two reflector arrangements are generally provided for generation of different light distributions.

For example, the first reflector arrangement is provided for generation of a high beam distribution.

Furthermore, the second reflector arrangement is provided for example for generation of a dipped beam distribution.

In a specific, simple embodiment of the invention, the first reflector arrangement comprises precisely one reflector and/or the second reflector arrangement comprises precisely one reflector, wherein each reflector arrangement preferably comprises precisely one reflector.

The reflectors or the reflector arrangements may be arranged in principle arbitrarily relative to one another, for example opposite one another laterally (right-left), in accordance with the light exposures to be generated. With the generation of dipped beam light and high beam light with a respective reflector arrangement, it is advantageous if the reflector arrangements or the two reflectors of the two reflector arrangements are arranged one above the other, for example the high beam reflector above and the dipped beam reflector below.

For adjustment of the at least one adjustable reflector, an adjustment element, preferably an adjustment screw, is mounted on the assembly main body, by means of which the at least one adjustable reflector can also be set with respect to the assembly main body and consequently also with respect to the stationary reflector arranged fixedly on the assembly main body.

The at least one adjustable reflector has an engagement region for engagement of the adjustment element, wherein, in the case of an adjustment screw, this adjustment screw has a thread that cooperates with a mating thread, said mating thread being arranged in the engagement region of the adjustable reflector.

The adjustment element could be a connecting rod for example, of which the linear movement is converted into a linear movement of the engagement region of the adjustable reflector. In the case of an adjustment screw, the rotational movement of said screw is converted into a linear movement of the engagement region, and the accuracy of the adjustment movement can also be set accordingly by means of a correspondingly fine selection of the thread turn and can be selected much more finely than in the case of a connecting rod.

In order to receive the movement conveyed by the adjustment element, the engagement region is articulated to the at least one adjustable reflector.

Here, the engagement region is preferably connected to at least one adjustable reflector via a deformable or flexible region, preferably a resiliently deformable or resiliently flexible region.

The movements occurring can be received in this manner, and at the same time the production is simpler than the attachment of an external joint, since the engagement region can be formed in one piece with the reflector, in particular in the case of a plastic reflector.

Furthermore, the adjustable reflector has at least one bearing, by means of which it is rotatably mounted on at least one counterbearing, which is formed on the assembly body.

With one or more such bearings, a pivot axis is defined, about which the adjustable reflector with the adjustment element is pivotable. Due to the pivoting of the reflector, the light exposure can be aligned, for example vertically, that is to say, for example in the case of a dipped beam reflector, the position/height of the light/dark boundary in the dipped beam exposure can be set so that the legal provisions are met.

In terms of construction, it has proven to be expedient if the at least one counterbearing is formed on the assembly exchange body.

This at least one counterbearing or the preferably two counterbearings form an axis of rotation at the assembly exchange body, about which the adjustable reflector can be pivoted and can be set in terms of its position with respect to the fixed reflector and with respect to the light source.

The LEDs are positioned accurately with respect to the counterbearing(s), and, once the assembly exchange body has been exchanged, the new LEDs are again located in a position identical to that of the exchanged LEDs; the light exposure is thus also correct again, since the position of the reflector is defined by the counterbearing.

With the counterbearing, the axis of rotation is thus defined, the reflector is held in position, and, when the light sources are exchanged, the new light sources are again arranged in the same position as the exchanged light sources.

It has proven to be expedient if a counterbearing is formed as the end region of an extension protruding from the assembly exchange body, said extension projecting through the through-opening in the assembly main body when the assembly body is in the assembled state.

The end region of a protruding extension forms the bearing point or the centre of rotation for the adjustable reflector; with two extensions an axis of rotation for the pivotable reflector is produced.

It is accordingly advantageous if two bearings and two counterbearings are provided.

Here, the two extensions for the counterbearings are preferably arranged on either side of the light source support element.

In order to hold the adjustable reflector in a stable manner in its position during travel and accordingly in the event of vibrations, but in particular in order to hold the adjustable reflector in its set position, even after the removal of the light sources, which is achieved by removing the assembly exchange body (and therefore potentially also by removing the extension or the extensions with the counterbearing(s)), the adjustable reflector is adjustable against a restoring force with respect to the stationary reflector or the assembly main body.

The restoring force is preferably exerted by at least one spring element, preferably two spring elements.

In particular, the at least one spring element is fixedly attached to the stationary reflector or preferably to the pivotable reflector and is releasably fastened to the other reflector.

In accordance with a specific advantageous embodiment, the at least one spring element can be fastened via a detent portion in a corresponding detent seat, said detent seat preferably being formed on the stationary reflector.

This at least one detent portion, for example in the form of a detent hook, allows a simple assembly of the vehicle headlight, since the detent portions can be easily fixed into the detent seats.

To cool the light sources, the assembly exchange body and/or the assembly main body is/are formed from a good heat-conductive material, for example from aluminium, wherein both bodies are preferably formed from a good heat-conductive material. The assembly exchange body and the assembly main body have to ensure good thermal transfer in the assembled state and are connected as a result of the assembly to a cooling body, whereby optimal thermal dissipation is also provided.

Lastly, referencing or positioning means are also provided on the assembly main body and on the at least one stationary reflector in order to fasten the stationary reflector to the assembly main body in a positionally accurate manner.

The stationary reflector can thus be positioned on the assembly main body in an exact manner and then fastened, for example by means of screws, etc.

Figure 2:
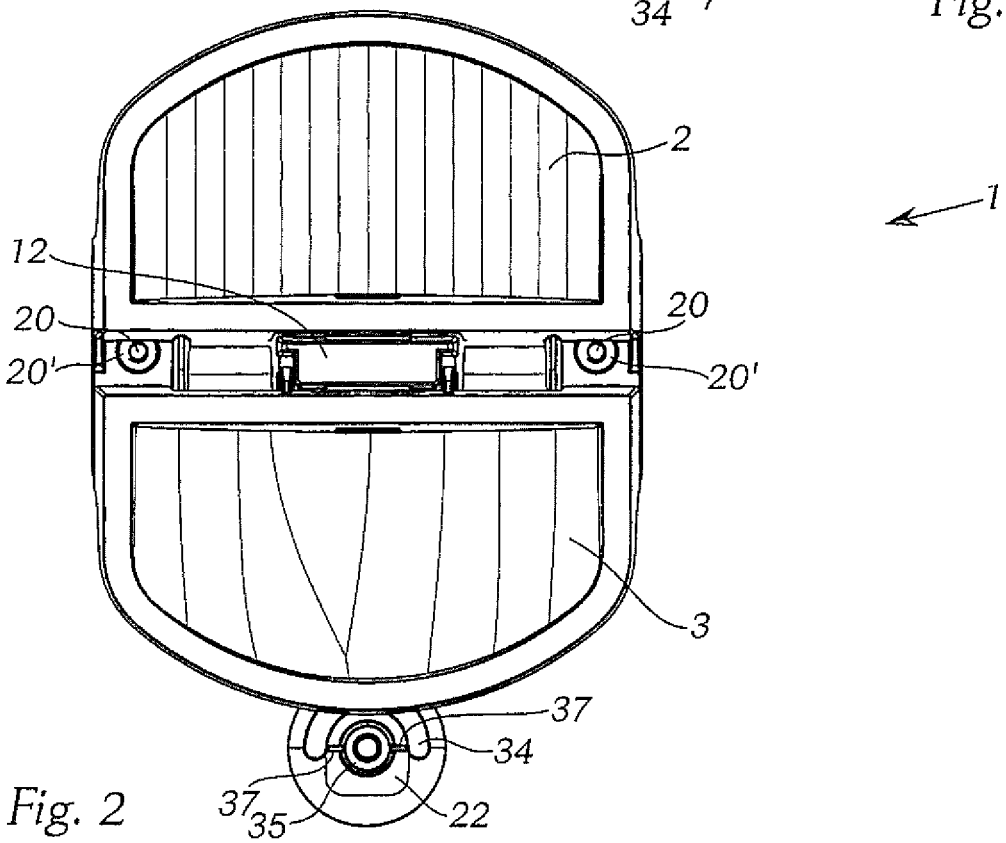
Figure 3:
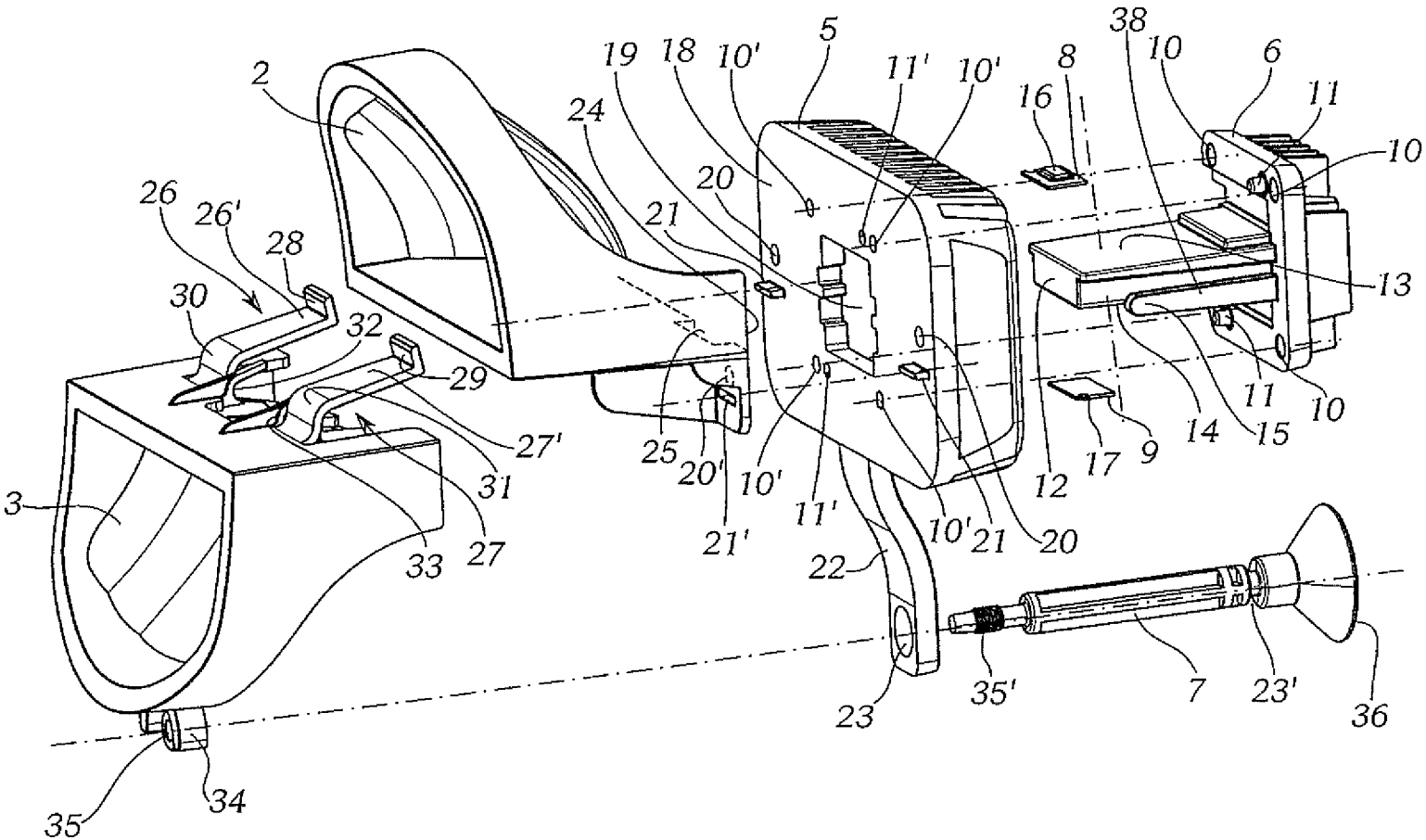
Figure 4:
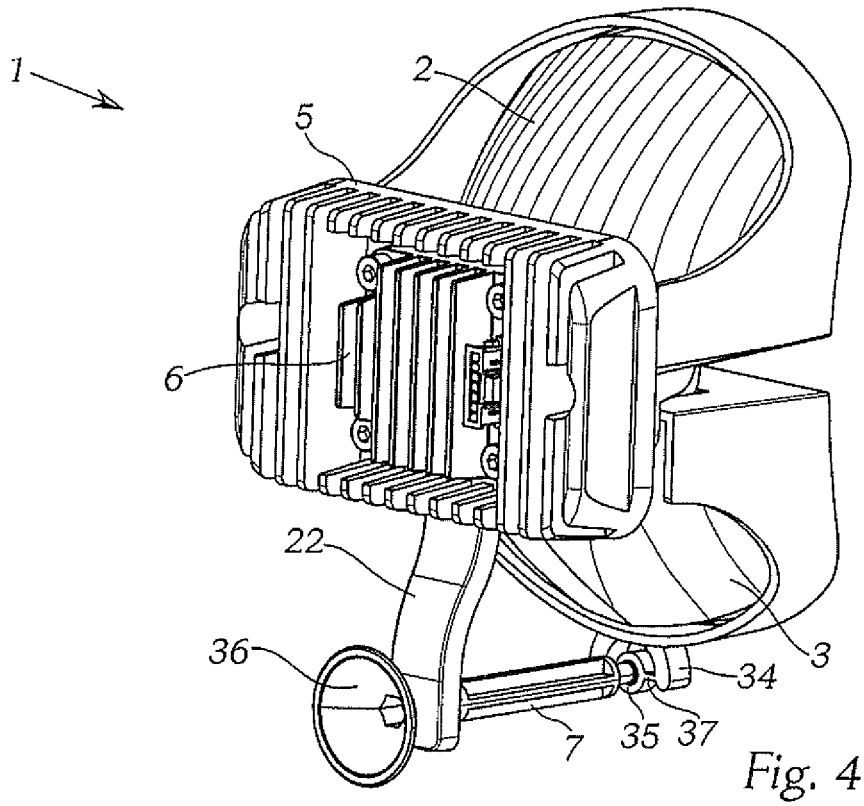
Figure 5:
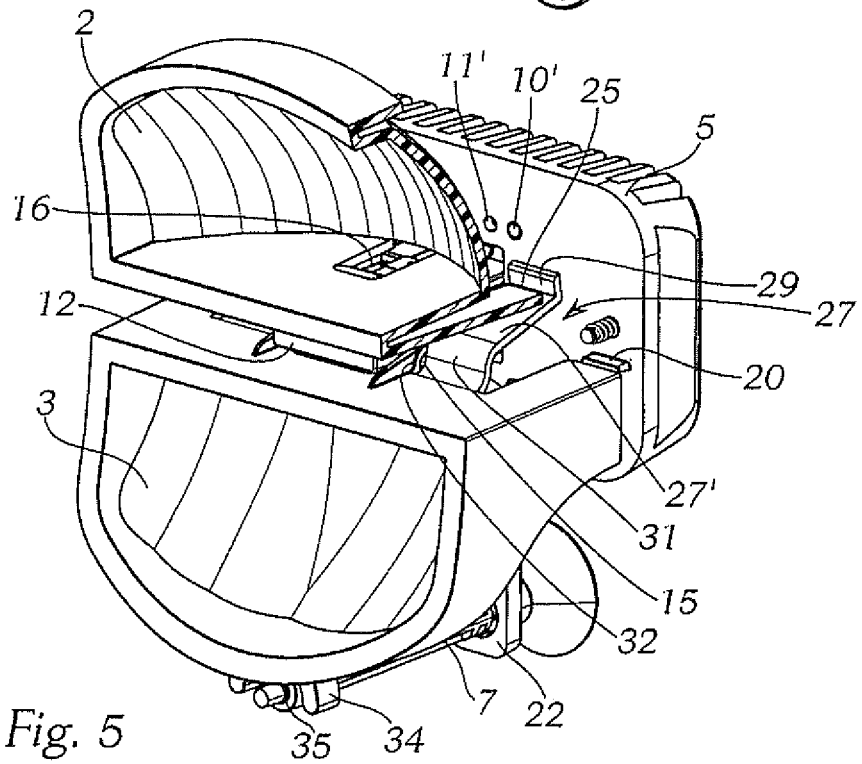
Figure 6:
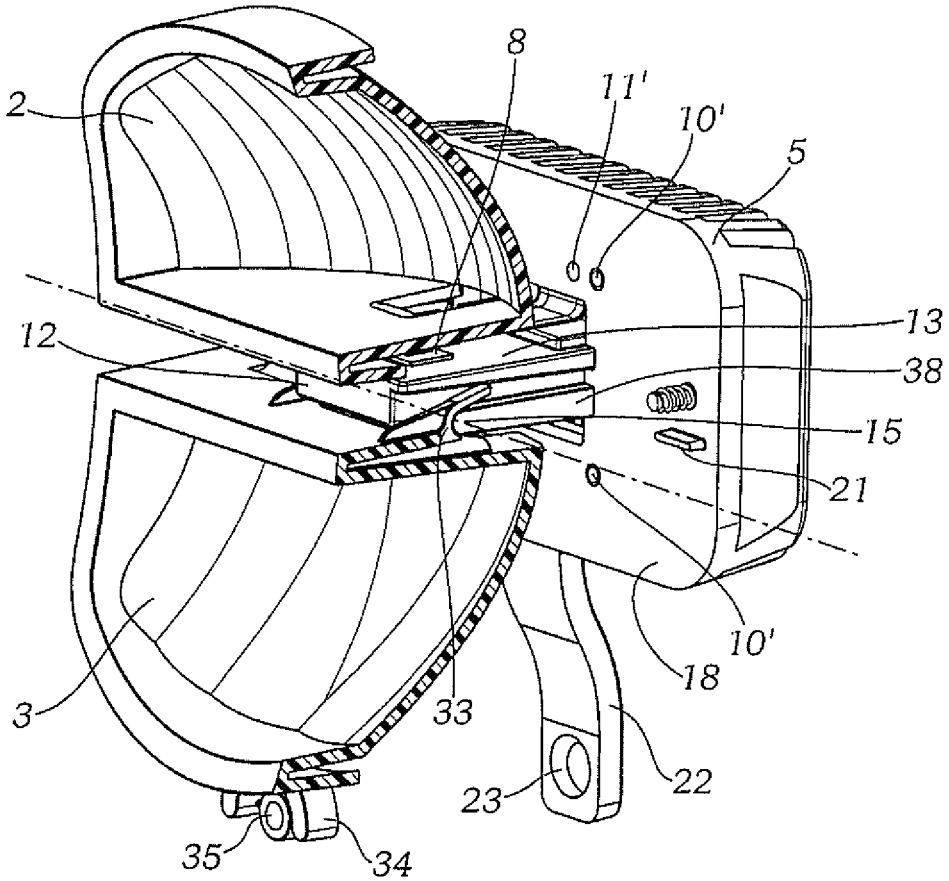

The invention will be explained in greater detail hereinafter on the basis of the drawing, in which:

FIG. 1 shows a perspective view at an angle from the front of a headlight according to the invention, FIG. 2 shows the headlight from FIG. 1 from the front, FIG. 3 shows an exploded illustration of the headlight from FIG. 1, FIG. 4 shows a perspective view at an angle from behind of the headlight from FIG. 1, FIG. 5 shows a partly cut-away illustration of the headlight from FIG. 1, and FIG. 6 shows a further partly cut-away illustration of the headlight from FIG. 1.

FIGS. 1 and 2 show a vehicle headlight 1 with a first reflector arrangement, which comprises a (upper) stationary reflector 2, and with a second reflector arrangement, which comprises a (lower) reflector 3 adjustable with respect to the stationary reflector 2 of the first reflector arrangement. The upper reflector 2 is used for example to generate a high beam distribution (high beam reflector), and the lower reflector 3 is used for example to generate a dipped beam distribution (dipped beam reflector).

The example shown with dipped beam and high beam reflectors is often produced, however other light distributions, such as daytime running light (DRL), fog light and other light distributions, may also be provided.

Each reflector 2, 3 is illuminated by at least one light source 16, 17, for example the upper reflector 2 is illuminated by a light source 16 and the lower reflector 3 is illuminated by a light source 17, as shown in FIG. 3. The two light sources 16, 17 are LED light sources, that is to say each light source 16, 17 comprises one or more LEDs. In the shown variant, 8, 9 each denote an LED print, on which the actual light sources 16, 17 sit, specifically one or more LED chips in each case (depending on the quantity of light required).

The light sources 16, 17 or the LED prints 8, 9 are attached on a common assembly body 4. This assembly body 4 consists of an assembly main body 5, on which the reflector 2 is assembled in a stationary manner with its reference face 24 against a reference face 18 of the assembly main body 5, and also of an assembly exchange body 6, to which the two light sources 16, 17 are fastened.

The adjustable reflector 3 is arranged on the same side of the assembly main body 5 as the stationary reflector 2 and is adjustable with respect to the stationary reflector 2, that is to say is pivotable by an axis that is horizontal for example, as shown and illustrated as a dash-dot line (FIG. 6) (in the installed state of the vehicle headlight).

The assembly body 4 is thus divided into an assembly main body 5 and into an assembly exchange body 6. The light sources 8, 9 are then fastened on a light source support element 12, more specifically on the upper assembly face 13 and lower assembly face 14 thereof, said support element 12 being connected to the assembly exchange body 6, the support element 12 and the assembly exchange body 6 preferably being formed in one piece, and, as will be discussed further below, being formed from a good heat-conductive material.

The assembly main body 5 has a through-opening 19 so that the light source support element 12 can be inserted and plugged through from the side of the assembly main body 5 facing away from the reflectors 2, 3.

The assembly exchange body 6 can be releasably fastened to the assembly main body 5, wherein referencing or positioning means 11, 11' (centering pin 11 and centering holes 11') are provided on the assembly exchange body 6 and on the assembly main body 5 in order to fasten the two bodies 5, 6 to one another in a positionally accurate manner.

In view of a simple manufacturing process, but also in view of a reliable positioning of the light sources and in particular in view of an optimal thermal dissipation, the light source support element 12 and the assembly exchange body 6 are formed in one piece.

To adjust the adjustable reflector 3, an adjustment element, preferably an adjustment screw 7, is mounted on the assembly main body 5 in a corresponding bearing 22, 23, for example in a type of tab 22 with a receptacle 23 (see also FIG. 3). By means of this adjustment screw 7, the adjustable reflector 3 can be set with respect with the assembly main body and consequently also with respect to the stationary reflector 2 arranged fixedly on the assembly main body, that is to say can be pivoted about an axis. To this end, the adjustment screw 7 has an adjustment knob 36, which a user can actuate/turn; this adjustment knob is preferably accessible from the outside, that is to say from outside a housing (not illustrated), or after removal of the housing or part of the housing.

In the preferred variant shown here, the tab 22 is integrally moulded on the assembly main body 5, for example is formed in one piece therewith. However, the adjustment screw may also be mounted on the housing, and in this case the tab 22 is not necessary. The screw is then mounted directly on the housing.

If the adjustment screw is accessible from the outside, the adjustment screw 7 has to be sealed with respect to the housing so that no moisture or dirt can infiltrate from the outside into the interior of the housing (not illustrated). This seal is achieved for example by an O-ring, which comes to lie in a groove 23' on the adjustment screw 7.

The adjustable reflector 3 has an engagement region 34 (receiving tab 34) for engagement of the adjustment screw 7, said adjustment screw 7 having a thread 35' (FIG. 3), which cooperates with a mating thread 35. This mating thread 35 is arranged in the engagement region 34 of the adjustable reflector 3.

In order to receive the movement conveyed by the adjustment screw 7, the engagement region is preferably articulated to the adjustable reflector.

Here, the engagement region 34 is advantageously connected to the adjustable reflector 3 via a deformable or flexible region 37, preferably a resiliently deformable or resiliently flexible region 37 (FIG. 4).

The movements occurring can also be received in this manner, and at the same time the production is simpler than the attachment of an external joint, since the engagement region can be formed in one piece with the reflector, in particular in the case of a plastic reflector.

Furthermore, the adjustable reflector 3 has bearings 32, 33, by means of which it is rotatably mounted at corresponding counterbearings 15, which are formed on the assembly body 4.

With these bearings or, strictly speaking, the counterbearings 15, a (horizontal) pivot axis is defined, about which the adjustable reflector 3 is pivotable with respect to the stationary reflector 2 by means of the adjustment screw 7. As a result of the pivot of the reflector 3, the light exposure can be set, for example vertically, that is to say, for example in the case of a dipped beam reflector, the position/height of the light/dark boundary in the dipped beam exposure can be set so that the legal provisions are met.

As can be deduced from FIG. 3 and also FIG. 6, the counterbearings 15 are formed on the assembly exchange body 6. (Only one counterbearing 15 can be seen in each of the respective figures, the other counterbearing is obscured).

The LEDs are positioned accurately with respect to the counterbearing(s) 15 and, after an exchange of the assembly exchange body 6, the new LEDs are again located in a position identical to that of the exchanged LEDs; the light exposure is thus also again correct, since the position of the reflector 3 is defined by the counterbearing 15.

With the counterbearing 15, the axis of rotation is thus defined, the reflector is held in position, and is again positioned in the same position when the part 6 is exchanged.

As can also be seen in the figures, a counterbearing is formed as the end region 15 of an extension 38 protruding from the assembly exchange body 6, said extension protruding through the through-opening 19 in the assembly main body 5 in the assembled state of the assembly body 4.

The end region 15 of a protruding extension 38 forms a bearing point or centre of rotation for the adjustable reflector; with two extensions an axis of rotation for the pivotable reflector is produced.

Here, the two extensions for the counterbearings 15 are arranged on either side of the light source support element 12.

In order to hold the adjustable reflector in a stable manner in its position during travel and accordingly in the event of vibrations, but in particular in order to hold the adjustable reflector in its set position, even after the removal of the light sources, which is achieved by removing the assembly exchange body (and therefore potentially also by removing the extension or the extensions with the counterbearing(s)), the adjustable reflector 3 is adjustable against a restoring force with respect to the stationary reflector 2 or the assembly main body 5.

With the variant shown (in particular see FIGS. 3, 5 and 6), the restoring force is exerted by two spring elements 26, 27.

Here, the spring elements 26, 27 are attached fixedly to the pivotable reflector 3 and are fastened releasably to the other stationary reflector 2.

To this end, the spring elements 26, 27 have detent portions (detent hooks) 28, 29, which can be fastened (can be fixed) in corresponding detent seats 25, which are formed on the stationary reflector 2.

Such detent hooks allow a simple assembly of the vehicle headlight, since the detent portions can be easily fixed into the detent seats.

With the embodiment shown, the spring elements 26, 27 each have a rigid portion 26', 27' and a resilient region 30, 31 in the form of a resilient nose, via which the spring elements 26, 27 are attached to the pivotable reflector 3, preferably are formed in one piece therewith.

To cool the light sources, the assembly exchange body and the assembly main body are formed from a good heat-conductive material, for example from aluminium. When assembled, the assembly exchange body and the assembly main body form a cooling body 4, whereby optimal thermal dissipation is provided, and the support 12 for the light sources is also formed from a good heat-conductive material.

Lastly, the referencing or positioning means 21, 21' (centering webs 21, centering openings 21') are also provided on the assembly main body 5 and on the at least one stationary reflector 2 in order to fasten the stationary reflector 2 to the assembly main body 5 (at the reference face 18 thereof) in a positionally accurate manner.

The stationary reflector can thus be positioned on the assembly main body in an exact manner and can then be fastened, for example by means of screws, etc. To this end, the assembly main body 5 has holes 20 and the stationary reflector 2 has holes 20' in a fastening portion, via which the reflector 2 can be screwed to the assembly main body 5.

Lastly, fastening holes 10 are also provided on the assembly exchange body 6, via which the assembly exchange body 6 can be screwed to the assembly main body 5 (holes 10').

The invention claimed is:

1. A vehicle headlight (1) with a first reflector arrangement, which comprises at least at least one stationary reflector (2), and with a second reflector arrangement, which comprises at least one reflector (3) adjustable with respect to the at least one stationary reflector (2) of the first reflector arrangement, characterized in that at least two light sources (16, 17) are provided, wherein each of the reflectors (2, 3) is assigned at least one of the light sources (16, 17), and wherein each light source (16, 17) comprises at least one LED, and with an assembly body (4) for fastening the at least one stationary reflector (2) and the at least two light sources (16, 17), wherein the assembly body (4) consists of an assembly main body (5), on which the at least one stationary reflector (2) is assembled in a stationary manner, and an assembly exchange body (6), on which the at least two light sources (16, 17) are fastened, and wherein the at least one adjustable reflector (3) is arranged on the same side of the assembly main body (5) as the at least one stationary reflector (2) and is adjustable with respect to the at least one stationary reflector (2), and wherein the assembly main body (5) has a through-opening (19) for insertion of a light source support element (12) from the side facing away from the reflectors (2, 3), wherein the light source support element (12) is connected to the assembly exchange body (6) and carries the at least two light sources (16, 17), and wherein the assembly exchange body (6) can be releasably fastened to the assembly main body (5), and wherein referencing or positioning means (11, 11') are provided on the assembly exchange body (6) and on the assembly main body (5) in order to fasten the two bodies (5, 6) to one another in a positionally accurate manner.

2. The vehicle headlight according to claim 1, characterized in that the light source support element (12) and the assembly exchange body (6) are formed in one piece.

3. The vehicle headlight according to claim 1, characterized in that the two reflector arrangements are provided for generation of different light distributions.

4. The vehicle headlight according to claim 1, characterized in that the first reflector arrangement is provided for generation of a high beam distribution.

5. The vehicle headlight according to claim 1, characterized in that the second reflector arrangement is provided for generation of a dipped beam distribution.

6. The vehicle headlight according to claim 1, characterized in that the first reflector arrangement comprises precisely one reflector (2) and/or the second reflector arrangement comprises precisely one reflector (3).

7. The vehicle headlight according to claim 1, characterized in that an adjustment element, preferably an adjustment screw (7), is mounted on the assembly main body (5) in order to adjust the at least one adjustable reflector (3).

8. The vehicle headlight according to claim 7, characterized in that the at least one adjustable reflector (3) has an engagement region (34) for engagement of the adjustment element.

9. The vehicle headlight according to claim 8, characterized in that the engagement region (34) is connected to at least one adjustable reflector (3) via a deformable or flexible region (37).

10. The vehicle headlight according to claim 9, wherein the deformable or flexible region (37) is a resiliently deformable or resiliently flexible region (37).

11. The vehicle headlight according to claim 7, characterized in that, in the case of an adjustment screw (7), said screw has a thread (35'), which cooperates with a mating thread (35), said mating thread (35) being arranged in the engagement region (34) of the adjustable reflector (3).

12. The vehicle headlight according to claim 1, characterized in that the adjustable reflector (3) has at least one bearing (32, 33), by means of which it is rotatably mounted on at least at one counterbearing (15), which is formed on the assembly body (4).

13. The vehicle headlight according to claim 12, characterized in that the at least one counterbearing (15) is formed on the assembly exchange body (6).

14. The vehicle headlight according to claim 13, characterized in that a counterbearing is formed as the end region (15) of an extension protruding from the assembly exchange body (6), said extension protruding through the through-opening (19) in the assembly main body (5) in the assembled state of the assembly body (4).

15. The vehicle headlight according to claim 14, characterized in that the two extensions for the counterbearings (15) are arranged on either side of the light source support element (12).

16. The vehicle headlight according to claim 12, characterized by two bearings (32, 33) and two counterbearings (15).

17. The vehicle headlight according to claim 1, characterized in that the adjustable reflector (3) is adjustable against a restoring force with respect to the stationary reflector (2) or the assembly main body (5).

18. The vehicle headlight according to claim 17, characterized in that the restoring force is exerted by at least one spring element.

19. The vehicle headlight according to claim 18, characterized in that the at least one spring element (26, 27) is attached fixedly to the stationary reflector (2) or to the pivotable reflector (3) and is releasably fastened to the other reflector (3).

20. The vehicle headlight according to claim 19, characterized in that the at least one spring element (26, 27) can be fastened via a detent portion (28, 29) in a corresponding detent seat.

21. The vehicle headlight according to claim 20, wherein the detent seat (25) is formed on the stationary reflector (2).

22. The vehicle headlight according to claim 18, wherein the restoring force is exerted by two spring elements (26, 27).

23. The vehicle headlight according to claim 1, characterized in that the assembly exchange body and/or the assembly main body is/are formed from a good heat-conductive material.

24. The vehicle headlight according to claim 1, characterized in that referencing or positioning means (21, 21') are provided on the assembly main body (5) and on the at least one stationary reflector (2) in order to fasten the stationary reflector (2) to the assembly main body (5) in a positionally accurate manner.

* * * * *